US008844585B2

(12) United States Patent
Laumer et al.

(10) Patent No.: US 8,844,585 B2
(45) Date of Patent: Sep. 30, 2014

(54) APPARATUS AND METHOD OF FILLING CONTAINERS WITH CLEANING DEVICE

(75) Inventors: Roland Laumer, Regensburg (DE); Manfred Schmid, Aufhausen (DE); Juergen Soellner, Beratzhausen (DE)

(73) Assignee: Krones AG (DE)

( * ) Notice: Subject to any disclaimer, the term of this patent is extended or adjusted under 35 U.S.C. 154(b) by 435 days.

(21) Appl. No.: 13/182,970

(22) Filed: Jul. 14, 2011

(65) Prior Publication Data

US 2012/0018030 A1 Jan. 26, 2012

(30) Foreign Application Priority Data

Jul. 21, 2010 (DE) ..... 10 2010 031 873

(51) Int. Cl.
*B65B 1/04* (2006.01)
*B67C 3/00* (2006.01)

(52) U.S. Cl.
CPC ..... *B67C 3/001* (2013.01)
USPC ..... 141/91; 141/93; 141/105

(58) Field of Classification Search
USPC ..... 141/85, 89–93, 104, 105
See application file for complete search history.

(56) References Cited

U.S. PATENT DOCUMENTS

| | | | | |
|---|---|---|---|---|
| 4,832,096 | A * | 5/1989 | Kohlbach | 141/114 |
| 5,848,515 | A | 12/1998 | Catelli et al. | 53/167 |
| 6,026,867 | A * | 2/2000 | Klarl | 141/91 |
| 6,079,460 | A * | 6/2000 | Ballan et al. | 141/145 |
| 6,457,497 | B1 * | 10/2002 | Adriansens et al. | 141/91 |
| 7,341,079 | B2 * | 3/2008 | Zanga | 141/92 |
| 8,096,330 | B2 * | 1/2012 | Mazzon | 141/91 |
| 8,117,803 | B2 * | 2/2012 | Nishino et al. | 53/167 |
| 8,387,668 | B2 * | 3/2013 | Macquet et al. | 141/91 |
| 8,459,315 | B2 * | 6/2013 | Clusserath et al. | 141/90 |
| 8,567,454 | B2 * | 10/2013 | Mastio et al. | 141/91 |
| 2009/0071104 | A1 | 3/2009 | Fischer | 53/426 |

FOREIGN PATENT DOCUMENTS

| | | | |
|---|---|---|---|
| DE | 721 423 | 5/1942 | |
| DE | 43 31 745 | 3/1995 | B65B 55/10 |
| DE | 195 42 432 | 5/1997 | B67C 3/00 |
| DE | 10134037 | 1/2003 | A61L 2/14 |
| DE | 201 20 014 | 2/2003 | B67C 3/22 |
| DE | 10217145 | 10/2003 | B65B 43/60 |
| DE | 102005012507 | 9/2006 | B67C 7/00 |
| DE | 102007034837 | 1/2009 | B65B 35/26 |

(Continued)

OTHER PUBLICATIONS

European Search Report for Application Serial No. 11174078.3, dated Mar. 6, 2013 (7 pgs).

*Primary Examiner* — Jason K Niesz
(74) *Attorney, Agent, or Firm* — Hayes Soloway P.C.

(57) ABSTRACT

An apparatus for filling containers with a liquid and, in particular, with a beverage, with a plurality of filling elements which in each case have an outlet in order to pour the beverage into the containers, as well as a valve device in order to control the supply of the liquid into the containers, with a conveying device which conveys the containers along a pre-set conveying path at least for a time during the filling thereof with the liquid, and with a cleaning device which acts with a cleaning medium upon at least one region contacted by the liquid to be filled. At least one filling element is designed in such a way that the cleaning medium is freely discharged out of this filling element during a cleaning operation.

16 Claims, 2 Drawing Sheets

(56) References Cited

FOREIGN PATENT DOCUMENTS

| | | | |
|---|---|---|---|
| DE | 102010012569 | 9/2011 | ..... A61L 2/08 |
| EP | 0 885 838 | 12/1998 | ..... B67C 3/00 |
| GB | 1015188 | 12/1965 | |
| WO | WO 2007/132339 | 11/2007 | ..... B67C 3/00 |

* cited by examiner

APPARATUS AND METHOD OF FILLING CONTAINERS WITH CLEANING DEVICE

BACKGROUND OF THE INVENTION

The present invention relates to an apparatus and a method of treating containers. The invention is described with reference to an apparatus for filling containers with liquid and, in particular, with beverages, but it is also pointed out that the invention can also be used with other container treatment plants, such as for example blow moulding machines which shape plastics material pre-forms into plastics material containers.

Filling machines of this type have long been known from the prior art. In this way, for example, DE 201 20 014 describes a rotary filler for filling bottles with liquid which has a rotor which is rotatable about a vertical axis and on which a plurality of filling valves are arranged. In this case it is known from the prior art that filling devices of this type can be cleaned with a liquid cleaning agent within the context of a cleaning mode. This cleaning agent is usually supplied by way of the product feed line and thus cleans the individual filling elements and is then fed back again using a so-called CIP cap or cover. On account of this procedure it is therefore necessary in part for the cleaning agent to be fed back again through the plant by way of relatively complicated paths.

DE 195 42 432 describes a rotary-type device for the treatment of articles and, in particular, of containers. In this case a rotary connection for the conveying of liquid is provided between a fixed sub-assembly and a rotor sub-assembly.

The object of the present invention is to improve the cleaning possibilities for plants of this type.

SUMMARY OF THE INVENTION

An apparatus according to the invention for filling containers with a liquid and, in particular, with a beverage has a plurality of filling elements which in each case have an outlet in order to pour the beverage into the containers, as well as a valve device in order to control the supply of the liquid into the containers. In addition, the apparatus has a conveying device which conveys the containers and preferably also the filling elements along a pre-set conveying path at least for a time during the filling thereof with the liquid. In addition, a cleaning device is provided which acts with a cleaning medium upon at least one region of the apparatus contacted by the liquids to be filled and, in particular, upon at least one region of the filling elements.

According to the invention at least one filling element is designed in such a way that the cleaning medium is freely discharged out of this filling element during the cleaning operation.

Whereas the cleaning medium is usually fed back in the case of the prior art, it is provided within the scope of the present invention that the cleaning medium should be deliberately allowed to be discharged from the filling element or the outlet thereof. In this way, the cleaning medium is not fed back in a duct, but is freely discharged. In particular, the cleaning medium is not fed back in a duct at least in sections after the discharge from the filling element, but preferably drops freely downwards, i.e. is preferably discharged into a region which is situated below the filling element, i.e. closer to the centre of the Earth than the filling element.

It is advantageous for the individual filling elements to be conveyed along a circular filling path. It is advantageous for the filling elements to be arranged on a support which is rotatable about a substantially vertical axis. It is advantageous for the cleaning medium to be discharged substantially freely from a plurality of filling elements and preferably from all the filling elements during operation.

In this case the region contacted by the liquid to be filled is, in particular, regions of the filling elements such as for example the valve device, but also other supply lines by way of which the product is supplied to the filling elements.

The Applicants have recognized that, in contrast to the apparatus known in the previous prior art, it is also possible to let the cleaning medium be freely discharged. It is advantageous for the apparatus to have a collecting device in order to be able to collect the cleaning medium discharged from the filling element.

It is advantageous for the apparatus to be a rotary filing machine which, in a particularly preferred manner, has a central store. A SIP (sterilization in place) or a CIP (cleaning in place) return by way of a medium distributor is thus not provided in this case, but the sterilization medium or the cleaning media are discharged directly.

It is advantageous for the apparatus to have a clean room and the at least one filling element is arranged in such a way that the cleaning medium is discharged into this clean room during the cleaning operation. The invention is especially suitable in particular for arrangements with a clean room, since soiling by splashes can be prevented in this way, since the cleaning medium enters the clean room first. Apart from the supply and removal devices for the containers, it is advantageous for the clean room to be substantially closed off.

In the case of a further advantageous embodiment the clean room has an outflow for the removal of the cleaning medium. This outflow is thus used at the same time as a collecting device in order to collect the cleaning medium and to remove it again in a purposeful manner. In this case the cleaning medium can be conveyed to a return or preparation device.

In the case of a further advantageous embodiment the apparatus has a separating device for separating gaseous and liquid media discharged from the clean room. Gaseous media, such as for example a stressing gas for the containers, can also be discharged by way of the aforesaid outflow. It is advantageous for a separation of these media to be provided, such as can be carried out for example by the provision of a siphon or the like.

In the case of a further advantageous embodiment the apparatus has a movable liquid conveying device which is movable with respect to the outlet and which is capable of being placed in a cleaning mode on an outlet. This can prevent the cleaning medium from spraying into a plurality of directions starting from the outlet, but the liquid conveying device conveys the liquids in a purposeful manner into specified regions, for example in the direction of the outlet which is arranged in the sterile room.

In this case it is advantageous for this liquid conveying device to have an opening. In this way, the liquid conveying device can be a plate which has a circular opening for example, through which the cleaning medium is discharged.

In the case of a further advantageous embodiment the apparatus has at least one supply device in order to supply a gaseous medium to the containers (in particular before or during the filling procedure). In this case the apparatus is advantageously also arranged in such a way that this gaseous medium is capable of being released into the clean room. This embodiment is suitable in particular for filling machines which fill beverages with bound gases. During this filling the containers are first pre-stressed with a specified gas pressure. This gas is then released again to the filling procedure, it being proposed in this case that the gas should now also be removed into the clean room.

It is pointed out that the diversion of the pre-stressing gases described here and, in particular, the diversion of the pre-stressing gases into the sterile or clean room can also be applied independently of the release of the cleaning medium into the clean room as described above. It is advantageous for the gaseous medium which is used for the pre-stressing of the containers to be released into the clean room not directly out of the containers, but rather by way of an outlet line which in a particularly preferred manner opens into the clean room.

In the case of an advantageous embodiment the apparatus has a valve device for releasing the gaseous medium—in particular into the clean room.

It is also, however, pointed out that the discharge of the cleaning liquid described here can also be used for example in the case of shaping devices, in which case the cleaning medium can be let out for example by way of a blowing nozzle—which acts upon the plastics material pre-forms with a gaseous medium in order to expand them—and can be removed out of the sterile room. In this case a shaping device of this type also advantageously has a blow mould, inside which the plastics material pre-forms are capable of being expanded to form plastics material containers.

In the case of a further advantageous embodiment the apparatus has at least one cleaning device for cleaning the clean room. In this way, spraying nozzles, which clean regions of the clean room and in particular wall regions inside the clean room, can be arranged for example inside the clean room. In this case these cleaning devices are advantageously arranged above the outlet, so that the cleaning medium discharged from the latter can be removed by way of the outlets.

The present invention further relates to a plant for the treatment of containers having an apparatus of the type described above and a sterilization device arranged upstream with respect to this apparatus in a conveying direction of the containers in order to sterilize the containers. It is advantageous for the plant also to have a shaping device for shaping plastics material pre-forms into plastics material containers, and this shaping device is advantageously arranged upstream of the aforesaid sterilization device in this case.

In this way it would be possible for the containers to be pre-heated once again after their shaping, then to be acted upon with a mixture of $H_2O_2$ and sterile air, and possibly then to be blown out with sterile hot air. After that, the containers could be cooled by blowing in cold sterile air and then supplied to the filling device.

In this case a device which has an evaporator for evaporating $H_2O_2$ and which then produces the aforesaid mixture and acts upon the containers with the latter could be used for example as the sterilization device. Other sterilization devices would also be possible, however, for example devices which sterilize the containers by the use of electron or laser radiation or by the use of UV light. In addition, a plurality of sterilization methods could be combined or a plurality of sterilization devices could even be arranged one behind the other in the conveying direction of the containers.

The present invention further relates to a method of operating an apparatus for filling containers with liquids, in which containers to be filled are conveyed along a pre-set conveying path and are filled with a liquid medium by means of a plurality of filling elements at least for a time during this conveying, and a cleaning mode being provided in which at least parts of the filling elements are acted upon with a cleaning medium. According to the invention, after the cleaning medium has acted upon the parts of the filling elements it is freely discharged out of these filling elements. It is thus also proposed with respect to the method that the cleaning medium should not be returned, but should be discharged immediately in particular into a clean room.

BRIEF DESCRIPTION OF THE DRAWINGS

Further advantages and embodiments may be seen from the accompanying drawings. In the drawings

DETAILED DESCRIPTION OF THE INVENTION

Figure 1:
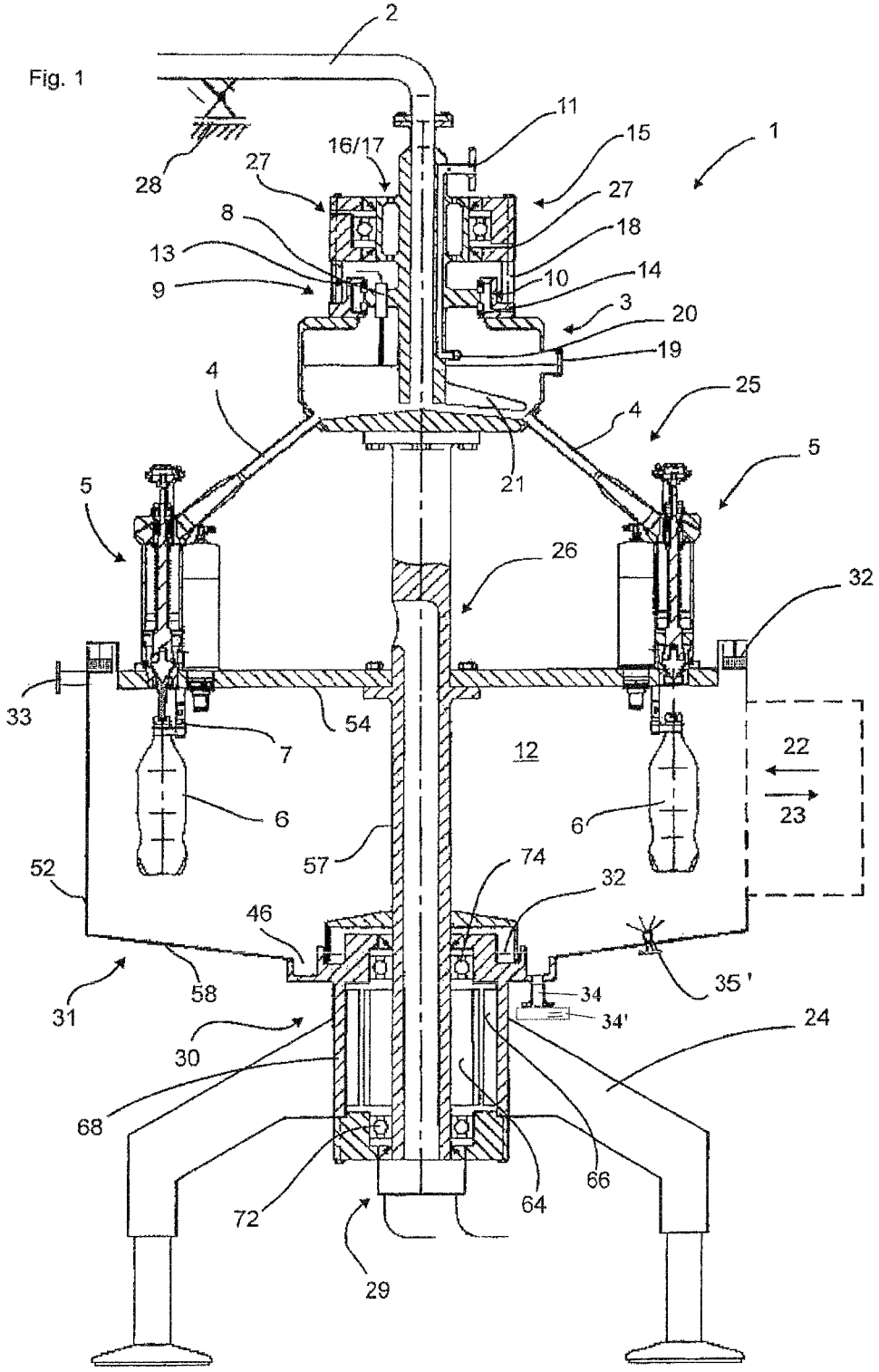
FIG. 1 shows a filling machine according to the invention which is particularly suitable for filling products under sterile conditions.

FIG. 1 shows the filling machine according to the invention in production. In this case no feeding of the media back by way of a distributor apparatus is provided for cleaning and for sterilization of the product paths. The liquid product is supplied to the rotating product container 3 by way of a feed line 2. The product flows by way of filling valves 5 into the containers 6 by way of a plurality of lines 4, the filling quantity preferably being determined by way of a measurement appliance, in a particularly preferred manner a throughflow meter, in the feed line 4 (not shown). Alternatively, the filling quantity can also be determined by way of a weighing apparatus on the container-receiving means 7. The level of the liquid in the product container 3 is advantageously determined by way of a level probe 8 which is advantageously incorporated in the stationary part of the rotary media distributor 9 and in a particularly advantageous manner determines the level. Since a cleaning medium is also conveyed by way of the feed line 2, the feed line 2 is also a component part of the cleaning device of the filling machine.

In the normal case a pressure equalization with the environment or with the clean room 12 respectively is formed by way of a gas path 11 in order to be able to carry out a purely gravimetric filling. In the case of a particularly viscous product the gas path 11 can also be used in order to produce an over-pressure in the product container 3, and in many cases a piston filling valve can then be used.

The reference number 9 designates a media distributor which distributes the liquid product to the individual filling valves 5. The rotary media distributor 9 has a slide ring seal 10 which in the case shown does not come into contact with the product. It is advantageous for the slide ring seal also to be sterilized on the rear side at least for a time in production. To this end, hot water or steam is supplied by way of a feed line 13 and at another place at the lowest point is applied for example to a condensate separator by way of a diversion line 14 preferably on the rotating part. In order to be able to convey the slide ring seal 10 a mounting 15 is provided. It is advantageous for this to be offset from the feed line 2 and the slide ring seal 10 in order to minimize the heat flow, in particular during the sterilization with steam. The temperature separation can be carried out either with cavities 16, thin-walled webs 17 or pins 18, or thermally insulating elements can also be used. The bearing housing can be provided with lubrication bores 27 and the feed line 2 can act at the same time as a torque support 28.

The reference number 3 designates a receiving container for receiving the liquid product. It is advantageous for the product container 3 to rotate. In the case of a plurality of product tracks a plurality of product containers can also be present, which are then advantageously arranged on the stationary part of the machine. In this case a multiple-track media distributor is arranged between the product containers and the filling valves. The inspection glass 19 is advantageously positioned in such a way that a spray ball 20 can also be replaced during maintenance operations. A stirring paddle 21, which is preferably arranged at the end of the feed line 2 and in a particularly preferred manner between the container supply and removal unit 22/23 (see also FIG. 2), can be provided instead of a stirring mechanism in the product container 3. It is used in the case of products with fibres, pulp or other solids for agitation, so that these solids cannot be deposited on the base of the container. In the case of this arrangement it is advantageous that a separate drive is not necessary for the stirring paddle on account of the relative rotary movement between the stirring paddle and the product container.

The reference number 24 designates a base frame of the apparatus. The base frame carries the rotating upper part 25 by means of a hollow shaft 26 situated centrally. Lines for supplying the upper part with current, control signals and pneumatic air can pass through the hollow shaft 26. A rotary distributor 29 is preferably arranged below the (electric motor) drive unit 30. The frame 24 also comprises the stationary clean room housing 31 which preferably seals off the stationary part from the rotating part of the filling machine by means of hydraulic sealing systems 32 in order to be able to maintain the clean room. Sterile air, possibly dried, is supplied by way of one or more supply air tubes 33. Media can be extracted by way of one or more outlets 34. A separation device 34' for separating liquid media (for example by way of a siphon downwards) and gaseous media (for example through a suction unit upwards) is arranged downstream of the outlets 34. The cleaning room is cleaned with one or more cleaning nozzles 35' which are attached to an automatically controlled cleaning system (not shown). A plurality of treatment units, such as for example container sterilization or cleaning and/or closure units, can also be integrated in the housing 31. Treatment units for the container sterilization or cleaning can apply widely varying treatment methods, such as for example treatment with liquid and/or gaseous media, treatment with plasma, treatment with radiation (UV, electron radiation) and are described for example in DE102005012507A1, DE102007034837A1, DE102010012569.5, DE10134037B4 or DE10217145A1. The subjects of these named specifications have been made the subject of the present application in their entirety by reference.

The drive unit 30 can be for example a direct drive—in particular without gears—which preferably has a high torque (a so-called torque motor). In this case the central shaft or the hollow shaft 26 and the rotor 64 of the motor can be designed in the form of a common component or can be designed in one piece. In this case it would be possible that for example permanent magnets of the rotor 64 are integrated in the hollow shaft 26 so that the rotor of the motor and the hollow shaft advantageously form a structural unit.

In addition, the stator 66 of the drive unit 30 and the housing 68 could be designed in the form of a common component or could form a structural unit. In this way, it would be possible for the stator magnets and optionally also supply lines to be already integrated into the housing in order to supply current to these magnets. These stator magnets are preferably electromagnets.

In this case the bearings 72, 74 illustrated in FIG. 1 are advantageously not a component part of the drive unit 30, but part of a machine mounting which could also be employed when using a conventional motor. These bearings 72, 74 advantageously support the housing 68 with respect to the hollow shaft 26. In the case of this embodiment it is advantageous for no additional mounting to be present in the motor between the motor shaft or hollow shaft 62 and the motor housing 68. It is preferable for the bearings 72, 74 to be sealed off in order to prevent the entry of extraneous substances.

It is therefore proposed to use a direct drive as the drive for the apparatus according to the invention. It is pointed out that this arrangement is also capable of being used independently of the invention described in the introduction for corresponding apparatus for filling containers.

In addition, however, a direct drive designed in this way could also be used for other apparatus for the treatment of containers which in particular have a conveying device which conveys the containers by means of a rotatable support. An apparatus of this type can be for example conveying star wheels, sterilization devices, blow moulding machines and the like.

Figure 2:
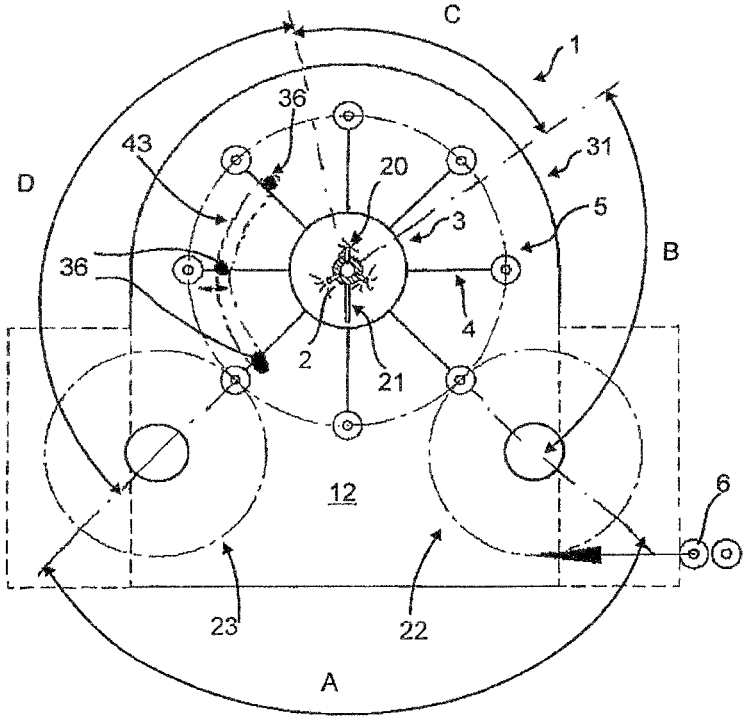
FIG. 2 is a top view of the apparatus as shown in FIG. 1.

The reference number 52 designates a boundary wall of the clean room which is stationary in operation, the reference number 54 designates a wall which is movable during the operation of the apparatus, and the reference number 57 designates the external periphery (likewise movable during the operation) of the central shaft, which in this case likewise forms a boundary wall of the clean room. FIG. 2 is a diagrammatic plan view of the filling machine. The stirring paddle 21 is preferably situated in the region of the angle A since the filling valves 5 are closed here. As a result the product flows more smoothly in the region of the opened filling valves. Three spray balls are preferably arranged in the container 3. The base 58 of the housing 31 shown in FIG. 1 is arranged obliquely, so that the media can run off to a channel 46 in which the outlet 34 is also arranged. The channel 46 is made continuous here and is inclined in the direction of the outlet 34, so that at least liquid media are directed towards the outlet 34.

The cleaning and sterilization of the paths in contact with the product and in contact with the media respectively are described below with reference to FIGS. 1 to 3. Those in contact with the product are the paths of the product preparation (for example product sterilization by means of short-term heating or UHT) mounted upstream, and possibly a sterile product buffer tank (which if present is preferably arranged above the filling machine 1), the feed line 2 in which valves are possibly fitted, and the product container 3 as far as the outlet 37 (FIG. 3) of the filling valve 5. This means that in this case the surfaces of the outlet 37 which are arranged between a filling valve cone 38 and the screen 36 are also included. If a plurality of product paths (for example for a beverage and for a syrup additive for the beverage) should be present, they are also in contact with the product. Those in contact with the media are all the paths which otherwise lead to the product container 3 and/or to the filling valve 5 and also away from them. By way of example nitrogen can be supplied in order to rinse the containers at the filling valve outlet 37 (cf. FIG. 3) in order to render inert the inner volume of the containers.

The cleaning of the paths in contact with the media and with the product is generally carried out by way of liquid cleaning agents, such as for example lye or acid, which are supplied by way of the feed lines 2 or by way of the gas path 11. By opening the filling valve cone 38 by means of a valve drive (not shown) (pneumatically, magnetically or by an electric motor) they are then left in the clean room and are drawn off by way of one or more outlets 34 and are optionally fed back or pumped at least for a time to the CTP plant for further use (for example in the cleaning circuit) or for reconditioning. By way of example it is possible for a first part of the cleaning agents or pre-rinsing water to be discarded into the duct after being drawn off out of the outlet 34 by way of a suitable valve arrangement which is capable of being controlled in an automated manner, since very many product residues are still rinsed out of the system in this step. If the major part of the product residues is rinsed out, the valve arrangement is switched in such a way that the circuit to the CIP plant is closed.

Figure 3:
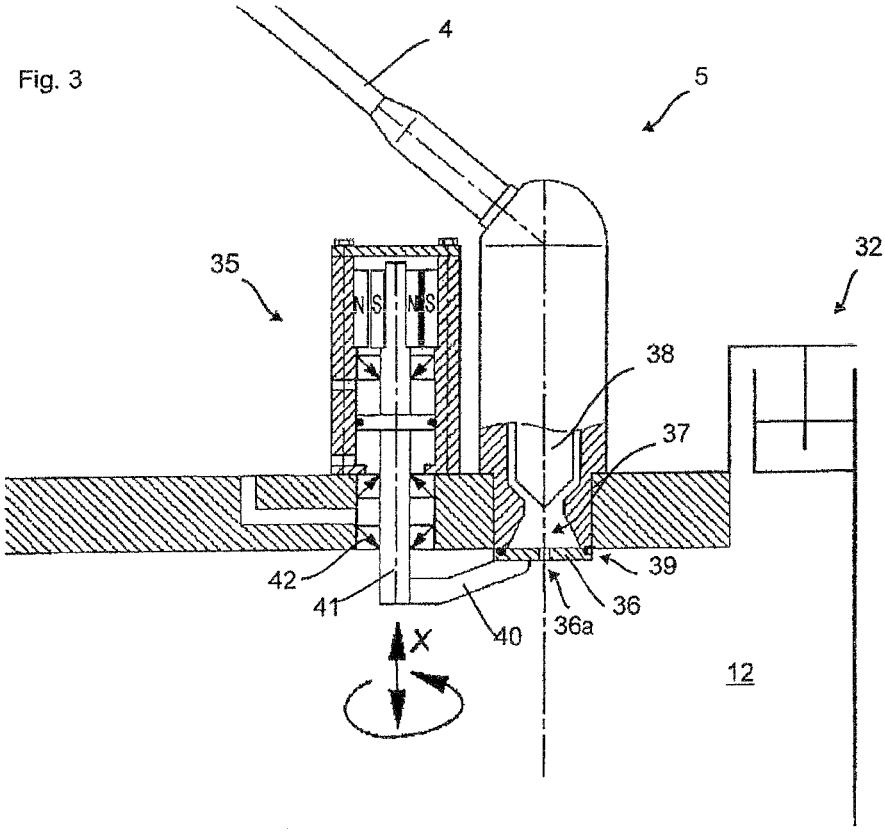
FIG. 3 is a detailed illustration of a filling element for an apparatus according to the invention.

FIG. 3 shows the filling valve 5 in the sterilization cycle. A pivoting-in and pressing apparatus 35 has pivoted-in a screen 36 with a bore 36*a*. The screen has a defined bore diameter which maintains the steam pressure in the filling valve 5 (if the nominal temperature is greater than 100° C., an overpressure must be built up with respect to the clean room 12). In this way the filling valve 5, the feed line 4, the product container 3 and other components which are in contact with the product or with the media are sterilized. The supply of the steam is carried out at least for a time by way of the feed line 2 and/or by way of the gas path 11 and/or by way of another, optionally additional track which leads to the product container 3. The screen 36 can be made adjustable in order to adjust the optimum bore diameter during the starting up of the apparatus.

In addition, gaseous media, such as for example $H_2O_2$, or liquid media, such as for example PES, can be added to the sterilization medium (preferably steam). The entire process is normally referred to as SIP (sterilization in place). The sterilization process is monitored by way of one or more temperature sensors which are preferably arranged in the filling valves and which in a particularly preferred manner are incorporated in the screen. It is also possible for an individual temperature sensor to be arranged in a stationary manner below the screen 36 which then plots the temperatures at the bore 36*a* for a time during the rotation of the upper part 25 when the valve passes over. The sensor can also be arranged so as to be capable of being pivoted in and it is preferably arranged in the angle between the container supply unit 22 and the container removal unit 23 (sector A in FIG. 2).

After the sterilization process a cooling phase of the upper part 25 takes place in the normal manner, it also being possible for this phase to be supported by media, for example with dried, and optionally cooled, sterile air or sterile inert gas.

Cleaning or sterilization is not necessary with every product change. If filling is carried out from a clear to a cloudy product it is advisable to fill the mixed phase into the containers and to convey it either closed or not closed on the normal container conveying path out of the clean room. In the case of viscous products an intermediate rinsing with a runny medium (for example drinking water with a 5% liquid $H_2O_2$ portion) is more advantageous. When a specified quantity is exceeded, it is appropriate for the medium to be allowed into the clean room by way of the filing valve and to be removed by way of one or more outlets 34.

The apparatus 35 is preferably used for pivoting in a screen 36 which seals off the filling valve outlet 37 either axially on the filling valve or preferably also radially. The reference number 40 designates an arm on which the screen 36 is arranged. The seal 39 can be either of an elastomer or of a hard plastics material or even of metal and can have a defined shape. The rotary and translatory movement of the screen with a lever can be driven either pneumatically/hydraulically and/or even electromagnetically. Depending upon requirements it may be necessary for screens with different bore diameters to be pivoted in, in which case an electromagnetic drive, as shown in FIG. 3, is then preferably implemented. By way of example a cap (screen without a bore) can also be pivoted in so as to prevent media from entering the filling valve during the cleaning and/or sterilization of the clean room 12. It is also advantageous for a plurality of filling valves to be operated by one apparatus 35. It is advantageous with respect to sterility if the drive or drives are situated outside the clean room. The rod 41 is preferably sealed by way of a shaft seal 42 which is movable in the X direction or is set on a bellows or diaphragm (not shown). If products which are less critical in microbiological terms are exclusively filled on the machine, the pivoting-in or pressing apparatus can also be situated in the clean room. It is then preferable for one or more segments 43 (FIG. 2) with a plurality of screens 36 to be introduced.

The filling of beverages with bonded gases (for example carbonated beverages) is described below. In order to be able to fill carbonated beverages, the container 6 has to be prestressed in a specified region B (FIG. 2). The container 6 is pressed against the filling valve outlet 37 by way of a lifting device or a bell of the filling valve moves towards the container in order to seal the container off with respect to the clean room. With the filling of carbonated beverages a further line (not shown) is normally present between the filling valve outlet 37 and the gas space of the product container 3, which can be switched by way of one or more valves. The valve is switched on after the container is pressed on, so that a pressure equalization is produced between the empty container 6 and the product tank 3. In contrast to the clean room, a pressure of up to 4 bar and more is then present in the prestressed container 6. As a result of the opening of the filling cap cone 38 (in the filling region C) the product can now flow into the container purely by gravity. When the desired filling quantity is achieved the filling cap cone 38 is closed.

In the release region D (FIG. 1) the filled bottle must now be released (gently) and in part in a plurality of steps. To this end a further line or bore which extends into the head space of the container and leads into the surroundings is necessary, the throughflow of which in the release region is controlled by one or more valves and/or throttle devices. The line or bore can be passed through the filling cap cone or, on the other hand, can also extend laterally for example into the outlet 37 of the filling valve. Since communication between the container, the filling valve and the surroundings is not desired in view of maintaining sterility in the product path or in the clean room, the release gas ($CO_2$) is preferably blown off into the clean room. The release gas is drawn out through one or more outlets 34 as a result of the air exchange in the clean room.

It can also be advantageous for this path in contact with the media to be acted upon with cleaning media and/or sterilization media by a connection (not shown) at a suitable point of the line or bore described above for pre-stressing and/or release, in which case too the respective medium can escape at the outlet 37 of the filling valve into the clean room and can be removed by way of the outlet 34.

In principle, beverage mixtures can also be produced in a filling plant of this type according to the invention. Two or more product paths then lead to the filling machine 1, and the various products are then supplied to the filling valves by way of preferably multiple-track media distributors. By way of example, a milk with a specified fat content fixed in advance can then be mixed in the filled container from milk with different fat contents in two product paths. The addition of syrup for example into a closed filling valve 5 in the region A of the filing machine is particularly important. The syrup portion is then rinsed completely by the following main portion of the filled product, for example water, into the container 6. It is advantageous for all further paths which are in contact with the product or media to be adequately cleaned in the preparation of production by switching on valves provided therefor on the rotating upper part 25 and also to be adequately sterilized in an aseptic (germ-free) filling which is sought.

The Applicants reserve the right to claim all the features disclosed in the application documents as being essential to the invention, insofar as they are novel either individually or in combination as compared with the prior art.

LIST OF REFERENCES

1 filling machine, apparatus
2 feed line
3 product container, receiving container, product tank
4 line
5 filling valves
6 container
7 container-receiving means
8 level probe
9 rotary media distributor
10 slide ring seal
11 gas path
12 clean room
13 feed line
14 diversion line
15 mounting
16 cavities
17 webs
18 pins
19 inspection glass
20 spraying ball
21 stirring paddle
22, 23 container supply and removal unit
24 base frame
25 upper part
26 hollow shaft
27 lubrication bores
28 torque support
29 rotary distributor
30 drive unit
31 clean room housing
32 hydraulic sealing system
33 air pipes
34 outlet
34' separation device
35' cleaning nozzle, pivoting-in/pressing apparatus, apparatus
36 screen
36*a* bore
37 outlet
38 filling valve cone
39 seal
40 arm
41 rod
42 shaft seal
43 segments
44 separating device
46 channel
52 boundary wall
54 movable wall
56 shaft
57 external periphery of the central shaft
58 base of the housing 31
64 rotor of the drive unit
66 stator of the drive unit
68 housing of the drive unit
72, 74 bearings
A to D sectors, portions

The invention claimed is:

1. An apparatus for filling containers with a liquid and, in particular, with a beverage, with a plurality of filling elements which in each case have an outlet in order to pour the beverage into the containers, as well as a valve device in order to control the supply of the liquid into the containers, with a conveying device which conveys the containers along a pre-set conveying path at least for a time during the filling thereof with the liquid, and with a cleaning device which acts with a cleaning medium upon at least one region contacted by the liquid to be filled, wherein at least one filling element is designed in such a way that the cleaning medium is freely discharged out of this filling element during a cleaning operation, and, wherein the apparatus has a liquid conveying device which is movable with respect to the outlet and which is capable of being placed in a cleaning mode on the outlet.

2. The apparatus according to claim 1, wherein the apparatus has a clean room and the at least one filling element is arranged in such a way that the cleaning medium is discharged into this clean room during the cleaning operation.

3. The apparatus according to claim 2, wherein the clean room has an outlet for the removal of the cleaning medium.

4. The apparatus according to claim 2, wherein the apparatus has a separating device for separating gaseous and liquid media discharged from the clean room.

5. The apparatus according to claim 1, wherein the liquid conveying device has an opening.

6. The apparatus according to claim 2, wherein the apparatus has at least one supply device in order to supply a gaseous medium to the containers, and the apparatus is arranged in such a way that this gaseous medium is capable of being released into the clean room.

7. The apparatus according to claim 2, wherein the apparatus has a valve device for releasing the gaseous medium into the clean room.

8. The apparatus according to claim 2, wherein the apparatus has at least one cleaning device for cleaning the clean room.

9. A plant for the treatment of containers with an apparatus according to claim 1 and a sterilization device arranged upstream with respect to this apparatus in a conveying direction of the containers in order to sterilize the containers.

10. A method of operating an apparatus for filling containers with liquids, wherein containers to be filled are conveyed along a pre-set conveying path and are filled with a liquid medium using a plurality of filling elements at least for a time during this conveying, and wherein a cleaning mode is provided in which at least parts of the filling elements are acted upon with a cleaning medium, wherein after the cleaning medium has acted upon the parts of the filling elements it is freely discharged out of the filling elements, and, wherein a liquid conveying device which is movable with respect to the outlet is placed, in the cleaning mode, on the outlet.

11. The apparatus according to claim 1, wherein the individual filling elements are conveyed along a circular filling path.

12. The apparatus according to claim 1, wherein the cleaning medium is discharged directly.

13. The apparatus according to claim 1, wherein the liquid conveying device is a plate or screen, which has a circular opening through which the cleaning medium is discharged.

14. The apparatus according to claim 8, wherein the at least one cleaning device for cleaning the clean room is a spray nozzle, which cleans regions of the clean room and is arranged inside the clean room.

15. The apparatus according to claim 3, wherein the cleaning medium is drawn off the clean room by way of one or more outlets and is fed back or pumped at least for a time to a clean in place plant.

16. The apparatus according to claim 15, wherein a first part of the cleaning medium is discarded into a duct by way of a suitable valve arrangement, which is capable of being controlled in an automated manner and after a major part of the product residues is rinsed out, the valve arrangement is switched in such a way that the circuit to the clean in place plant is closed.

* * * * *